US006830507B2

(12) United States Patent
Reich et al.

(10) Patent No.: US 6,830,507 B2
(45) Date of Patent: Dec. 14, 2004

(54) DUST AND CHIP REMOVAL DEVICE COMPRISING A DUST AND CHIP RETAINING DEVICE

(75) Inventors: Doris Reich, Stuttgart (DE); Steffen Wuesch, Holzgerlingen (DE); Siegfried Keusch, Deizisau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,183

(22) PCT Filed: May 25, 2001

(86) PCT No.: PCT/DE01/02025

§ 371 (c)(1),
(2), (4) Date: May 2, 2003

(87) PCT Pub. No.: WO02/07932

PCT Pub. Date: Jan. 31, 2002

(65) Prior Publication Data

US 2004/0132393 A1 Jul. 8, 2004

(30) Foreign Application Priority Data

Jul. 20, 2000 (DE) ..... 100 35 437

(51) Int. Cl.[7] ..... B24B 55/04
(52) U.S. Cl. ..... 451/453; 451/356; 451/456
(58) Field of Search ..... 451/453, 356, 451/354, 357, 358, 359, 451, 456

(56) References Cited

U.S. PATENT DOCUMENTS

| | | | | | |
|---|---|---|---|---|---|
| 4,598,500 | A | * | 7/1986 | Faraudo et al. | 451/456 |
| 5,349,752 | A | * | 9/1994 | Stirm | 30/124 |
| 6,047,693 | A | | 4/2000 | Yamami | |
| 6,432,154 | B2 | * | 8/2002 | Oh et al. | 55/423 |
| 6,514,131 | B1 | * | 2/2003 | Reich et al. | 451/344 |
| 6,746,321 | B2 | * | 6/2004 | Link | 451/354 |

FOREIGN PATENT DOCUMENTS

EP 0 842 736 A 5/1998

* cited by examiner

*Primary Examiner*—M. Rachuba
(74) *Attorney, Agent, or Firm*—Michael J. Striker

(57) ABSTRACT

A dust and chip removal device for sanding hand power tools has a storage container securable to a hand power tool, a transport channel via which dust and chips are directed into the storage container, a retaining element preventing the dust and chips from flowing back out of the storage container, the retaining element having at least one passage, an elastic element which has a holding force closing the at least one passage, the passage being openable automatically against the holding force at starting at a certain delivery pressure, while the elastic element automatically closes the passage below a certain delivery pressure, and a channel having cross-sectional area which tapers toward the passage.

9 Claims, 4 Drawing Sheets

DUST AND CHIP REMOVAL DEVICE COMPRISING A DUST AND CHIP RETAINING DEVICE

BACKGROUND OF THE INVENTION

The invention is based on a dust and chip removal device, with a dust and chip retaining device.

The use of power tools to draw off dust and chips from a working surface using a suction device and moving it through a transport channel into a storage container, e.g., into cloth dust bags or paper filters, is known.

To prevent the dust and chips from flowing back out of the storage container when the power tool is switched off, it is known to provide a dust and chip retaining device that comprises a manually operated retaining flap. An operator can manually close and open the storage container via the retaining flap.

A dust and chip removal device having a transport channel for a cutting hand power tool forming the general class is made known in U.S. Pat. No. 6,047,693. The transport channel is formed by a first tube section—a "tube connector"—secured to the hand power tool and by a second tube action secured to a dust bag.

The tube connector is equipped with a check valve inside that is located in a center section of the tube connector. The check valve comprises a cylindrical main body and a elastic poppet valve. The poppet valve is opened by compressed air generated by the dust suction fan, and it closes when the dust suction fan is switched off.

SUMMARY OF THE INVENTION

The invention is based on a dust and chip removal device, in particular for sanding hand power tools, having a transport channel, via which the dust and chips can be directed into a storage container secured to the hand power tool in particular, and having a dust and chip retaining device that comprises a retaining element to prevent the dust and chips from flowing back out of the storage container.

It is proposed that the retaining element comprises at least one passage that is closed by means of a holding force of an elastic element, and the passage opens automatically against the holding force starting at a certain delivery pressure, and the elastic element automatically closes the passage below a certain delivery pressure. Backflow of the dust and chips when the machine is switched off, and having the storage container accidentally closed during operation of the machine can be reliably prevented.

The holding force can be produced by means of a separate spring element, but the retaining element is advantageously made of a soft-elastic material, and the retaining element and the elastic element are designed as a single component, by way of which additional components, installation space, weight, assembly expense and costs can be spared.

If a channel has cross-sectional area that tapers toward the passage, and/or if the channel is designed in the shape of a nozzle, an advantageous opening behavior can be obtained with just a small amount of delivery pressure, and an increased particulate speed can be obtained in the region of the passage, by way of which a cleaning of the storage container in an anterior part closest to the passage and an advantageous filling of the storage container from the rear in the direction of the passage can be obtained.

The channel could basically be formed by a part of the machine or a part of the storage container. If the channel is formed by the retaining element, however, said retaining element can be used advantageously with a plurality of storage containers that can be produced cost-effectively, e.g., storage containers made of paper, and/or they can be used with multiple machines. With a channel formed by the retaining element and extending into the storage container, it can be further achieved that the weight of the dust and/or chips assists the elastic element in closing the passage when the machine is switched off and prevents the dust and/or chips from flowing back. This is accomplished in that the dust and/or chips act on the possibly elastically designed walls of the channel in the closing direction when the machine is switched off.

Instead of channel walls extending in the transport direction and toward each other toward the center, the tapering can also be produced advantageously by means of a protrusion extending against the transport direction. A reduction of the volume of the storage container caused by the tapering channel can be prevented, and a large volume in the storage container can be obtained.

In a further embodiment of the invention it is proposed that at least one wall of the tapering channel extends along an exponential function in the transport direction, by way of which advantageous flow conditions and an advantageous opening behavior can be obtained even when a small amount of delivery pressure is applied. Moreover, when the wall thickness of the retaining element decreases as it nears the passage, e.g., advantageously according to an exponential function, this has an advantageous effect on the opening behavior, especially when delivery pressures are low.

The passage can be formed by various embodiments appearing reasonable to one skilled in the art, e.g., by one or more incisions in a soft-elastic wall of the retaining element. If the passage is formed by at least two intersecting incisions, a large passage opening can be obtained in simple fashion.

It is further proposed that at least one seal and/or a support piece is integrally molded on the retaining element, by way of which additional components, weight and assembly expense can be spared.

The means of attaining the object according to the invention can be used with various devices appearing reasonable to one skilled in the art, but particularly advantageously with sanding hand power tools, such as hand-guided oscillating sanders, disk-type sanders, etc., with which fine chips and/or sanding dust are produced. Sanding dust and/or fine chips can be accelerated particularly advantageously via the nozzle-shaped channel and directed through the passage into a rear section of the storage container. Moreover, the means of attaining the solution according to the invention are used particularly advantageously with storage containers secured to the hand power tool that are moved into various positions with the hand power tool, and even into positions in which the dust and chips would flow back into the hand power tool out of the storage container when the hand power tool is switched off.

BRIEF DESCRIPTION OF THE DRAWINGS

Further advantages result from the following description of the drawing. Exemplary embodiments of the invention are presented in the drawings. The drawings, the description, and the claims contain numerous features in combination. One skilled in the art will advantageously consider them individually as well and combine them into reasonable further combinations.

DESCRIPTION OF THE PREFERRED EMBODIMENTS

Figure 1:
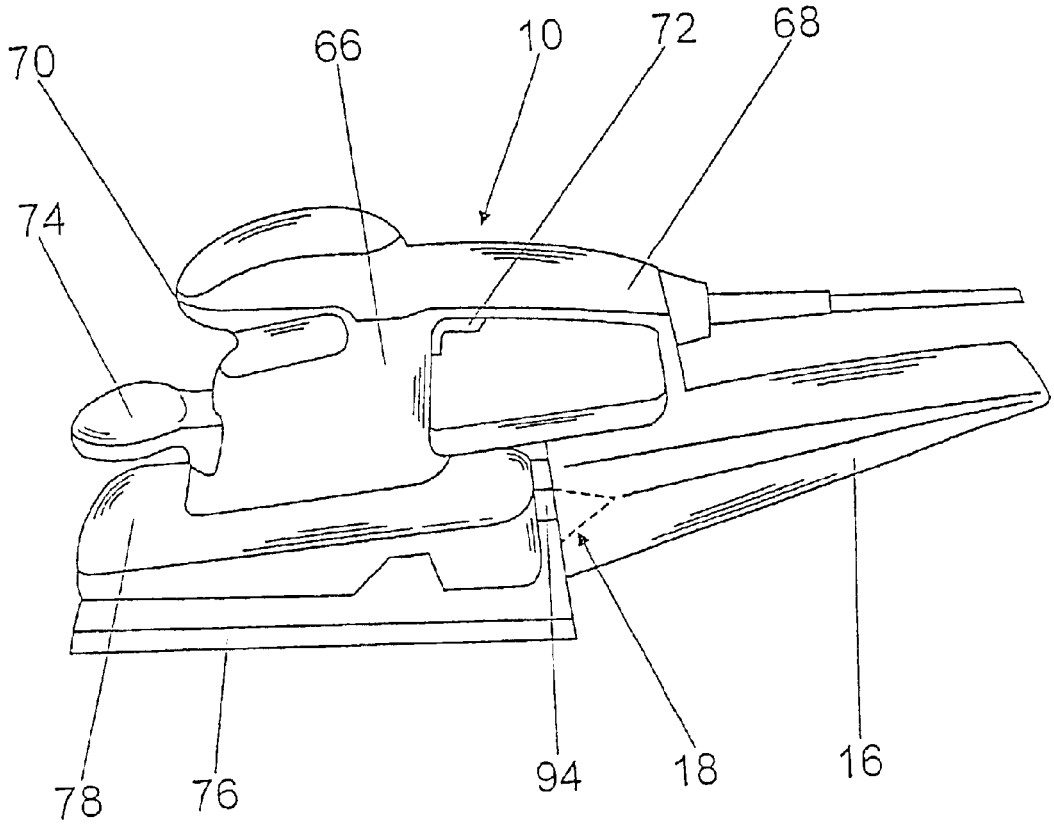
FIG. 1 is a schematic representation of an oscillating sander shown at an angle from above.
Figure 2:
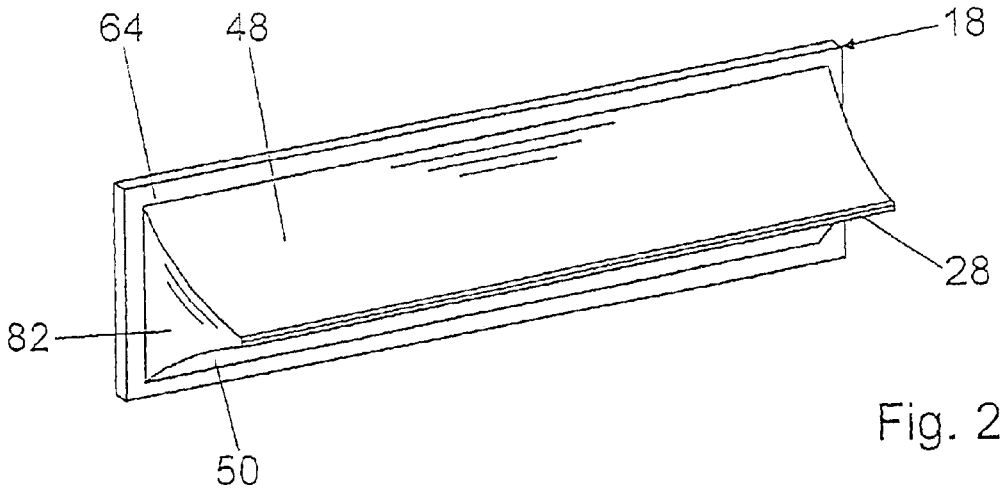
FIG. 2 is a view of a retaining element shown at an angle from the front.
Figure 3:
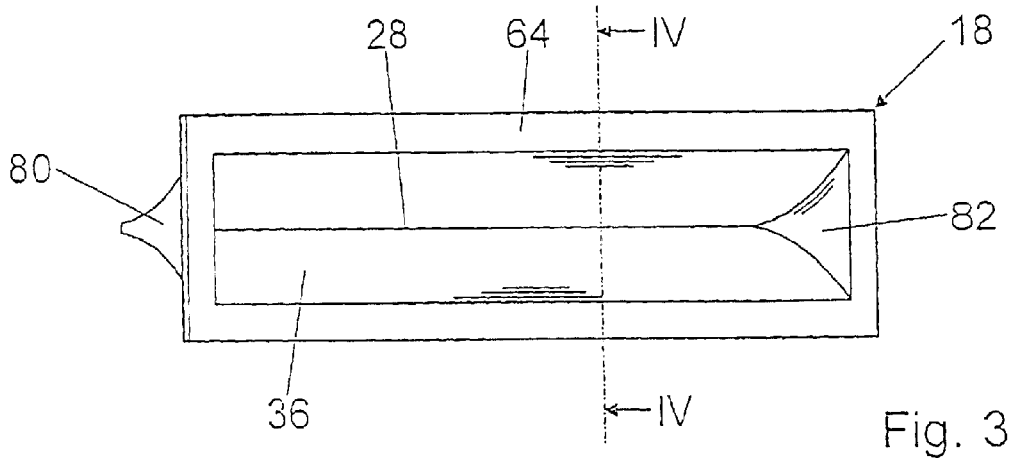
FIG. 3 is a view of the retaining element in FIG. 2 shown at an angle from the back.

FIG. 1 shows a schematic representation of a hand-guided oscillating sander 10 with an electric motor (not shown in greater detail) in a first housing part 66. Two handles 68, 70 are integrally molded on the housing part 66, i.e., a first handle 68—comprising an operating switch—extending in the longitudinal direction toward an operator, and a second handle 70 located on a side furthest away from a working surface in the upper region of the oscillating sander 10. Furthermore, a third handle 74 is secured in the longitudinal direction to a side opposite from the first handle 68.

Figure 4:
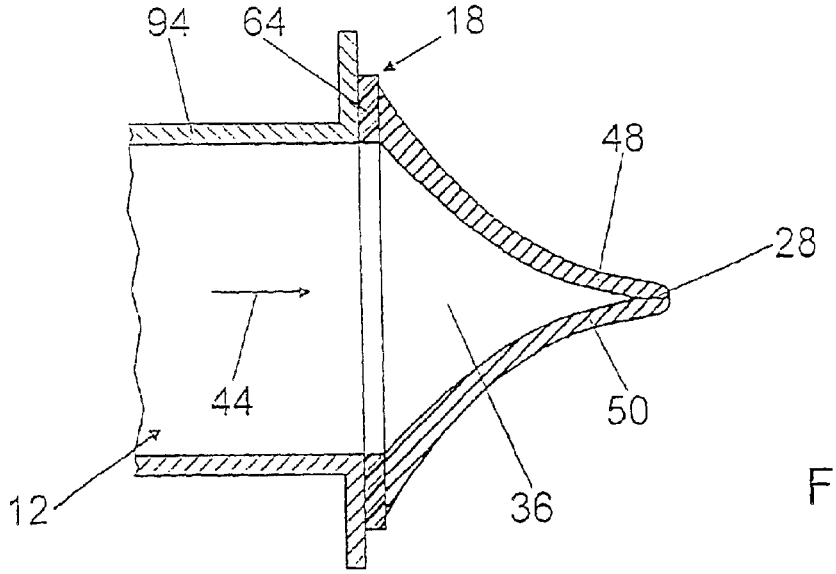
FIG. 4 is a sectional drawing along the line IV—IV in FIG. 3.

A second housing part 78 is located on the side closest to the working surface abutted by a plate-shaped tool carrier 76 driven by the electric motor. A fan (not shown in greater detail) of a dust and chip removal device is located in the housing part 78. A substantially rectangular connection piece 94 forming a transport channel 12 is integrally molded on the housing part 78 (FIGS. 1 and 4). During operation, the fan picks up dust and chips from the working surface and blows them through the transport channel 12 into a storage container 16 fitted onto the transport channel 12.

A dust and chip removal device having a funnel-shaped retaining element 18 is located between the transport channel 12 and the storage container 16 to prevent the dust and chips from flowing back out of the storage container 16 (FIGS. 1, 2, 3 and 4). The retaining element 18 is designed as a dual-component, injection-molded part. The retaining element 18 comprises a support piece 64 and/or a frame made of hard-elastic plastic, i.e., polypropylene (PP), having a rectangular base surface on which side walls 80, 82 made of hard-elastic plastic tapering toward each other and extending in the direction of the storage container 16 and/or in the transport direction 44 of the sanding dust are integrally molded. In addition to polypropylene (PP) and a hard-elastic plastic, other materials appearing reasonable to one skilled in the art are also feasible.

Moreover, walls 48, 50 made of an elastomer, i.e., an ethylene-propylene rubber (EPDM), are integrally molded on the support piece 64, forming a top side and a bottom side. The side walls could also be designed integral with the walls forming the top side and the bottom side. The walls 48, 50 extend toward each other in the transport direction 44, each one along an exponential function. Instead of ethylene-propylene rubber, rubber could be used as well. On their ends pointing toward the storage container 16, the walls 48, 50 come to bear against each other and form a passage 28 closed by means of their inner holding forces. The walls 48, 50 have a thickness that decreases in accordance with an exponential function in the direction toward the passage 28. The retaining element 18, by means of its walls 48, 50, 80, 82, forms a channel 36 tapering in the direction of the passage 28.

If the oscillating sander 10 is operated, dust and chips are blown into the channel 63. When a certain delivery pressure is reached, the walls 48, 50 are displaced against their inner holding force, and the passage 28 is opened. The sanding dust is accelerated through the tapering channel 36 and transported into a rear region of the storage container 16 furthest away from the passage 28. The storage container advantageously fills in the direction of the passage 28 starting at an end furthest away from the passage 28. If the oscillating sander 10 is switched off, the passage 28 is re-closed automatically by means of the inner holding forces of the walls 48, 50. Instead of two soft-elastic walls 48, 50, only one wall could be made soft-elastic.

Figure 5:
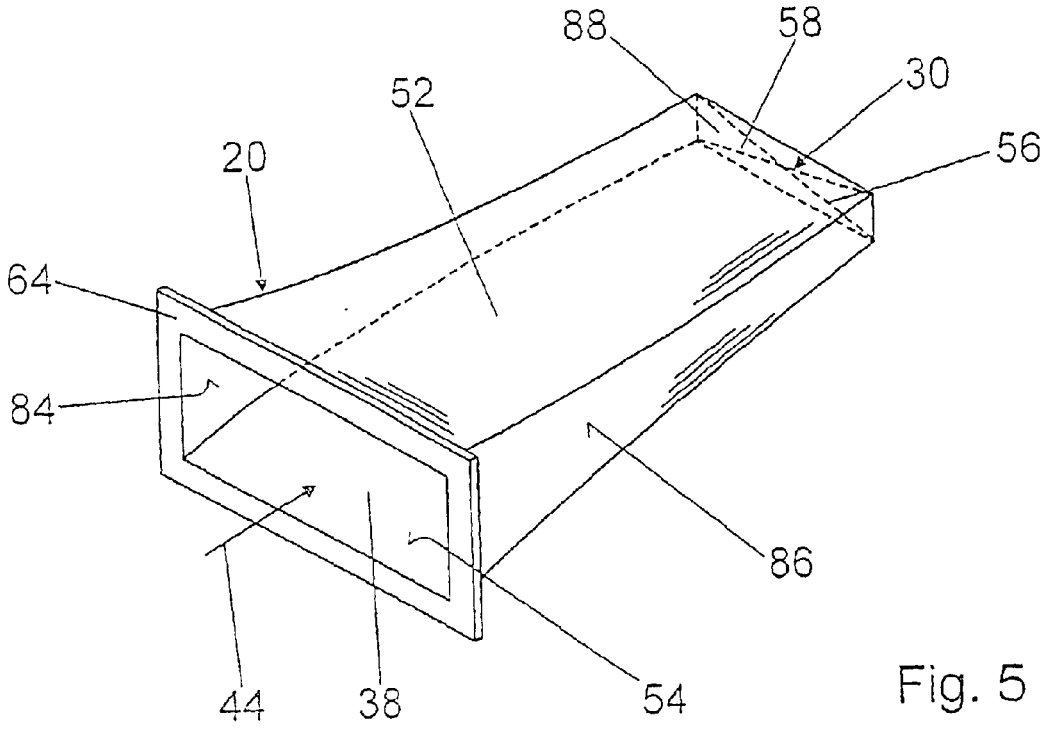
FIG. 5 is a variant of FIG. 2 with a passage formed by two intersecting incisions.

An alternative, funnel-shaped retaining element 20 is shown in FIG. 5. Components that essentially remain the same are basically labelled with the same reference numerals in the exemplary embodiments shown. Moreover, the description of the exemplary embodiment in FIGS. 1 through 4 can be referred to with regard for features and functions that are the same.

The retaining element 20 comprises a basic framework made of hard-elastic plastic, i.e., polypropylene (PP), having two side walls 84, 86—one wall 52 forming a top side, and one wall 54 forming a bottom side. The walls 52, 54 extend toward each other in the transport direction 44, each one along an exponential function. The retaining element 20 forms a channel 38 that tapers in the transport direction 44.

On an end pointing toward the storage container 16, the basic framework is closed by means of a wall 88 made of an elastomer, i.e., ethylene-propylene rubber (EPDM), in which said wall two diagonally extending, intersecting incisions 56, 58 are applied, forming a passage 30. Instead of a basic framework made of hard-elastic plastic, it would also be feasible to produce many or all of the walls out of a soft-elastic plastic.

Figure 6:
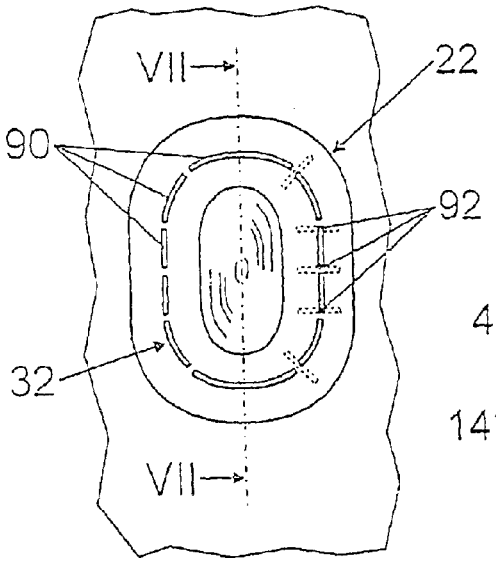
FIG. 6 is a variant of FIG. 2 with a protrusion extending against the transport direction.
Figure 7:
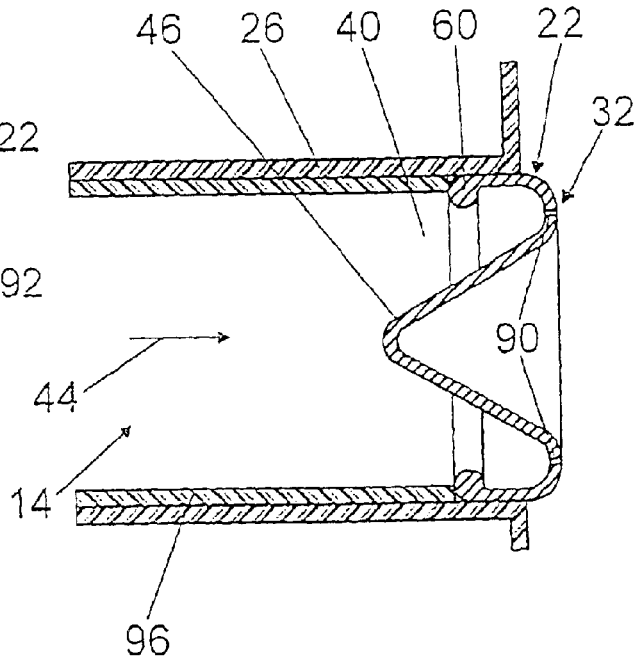
FIG. 7 is a sectional drawing along the line VII—VII in FIG. 6.

FIGS. 6 and 7 show a retaining element 22 made of an elastomer or ethylene-propylene rubber (EPDM) having an oval base surface for an oval connecting piece 96—forming a transport channel 14—of an oscillating sander. The retaining element 22 forms a channel 40 that tapers in the transport direction 44, whereby the tapering is produced by an initially rectangular protrusion 46 extending against the transport direction 44. The protrusion 46 is located in the center region of the retaining element 22, comprises an oval base surface, and is designed to taper in the nature of a funnel and/or it forms a cone tapering against the transport direction 44. Incisions 90 extending in the circumferential direction are formed in the retaining element 22 in a region of the retaining element 22 abutting the protrusion 46 radially outwardly next to a storage container, which said incisions form a passage 32. Furthermore, incisions 92 extending in the radial direction would also be feasible, as indicated in FIG. 6. The incisions 90, 92 are closed by means of an internal holding force of the retaining element 22 when the oscillating sander is switched off, and they open when a certain amount of delivery pressure is applied.

A ring seal 60 is integrally molded on the retaining element 22 that seals radially outwardly at a connecting piece 26—fitted onto the transport channel 14—of a storage container (not shown in greater detail) and, in the direction of the oscillating sander, at an end face of the connecting piece 96 facing the storage container.

Figure 8:
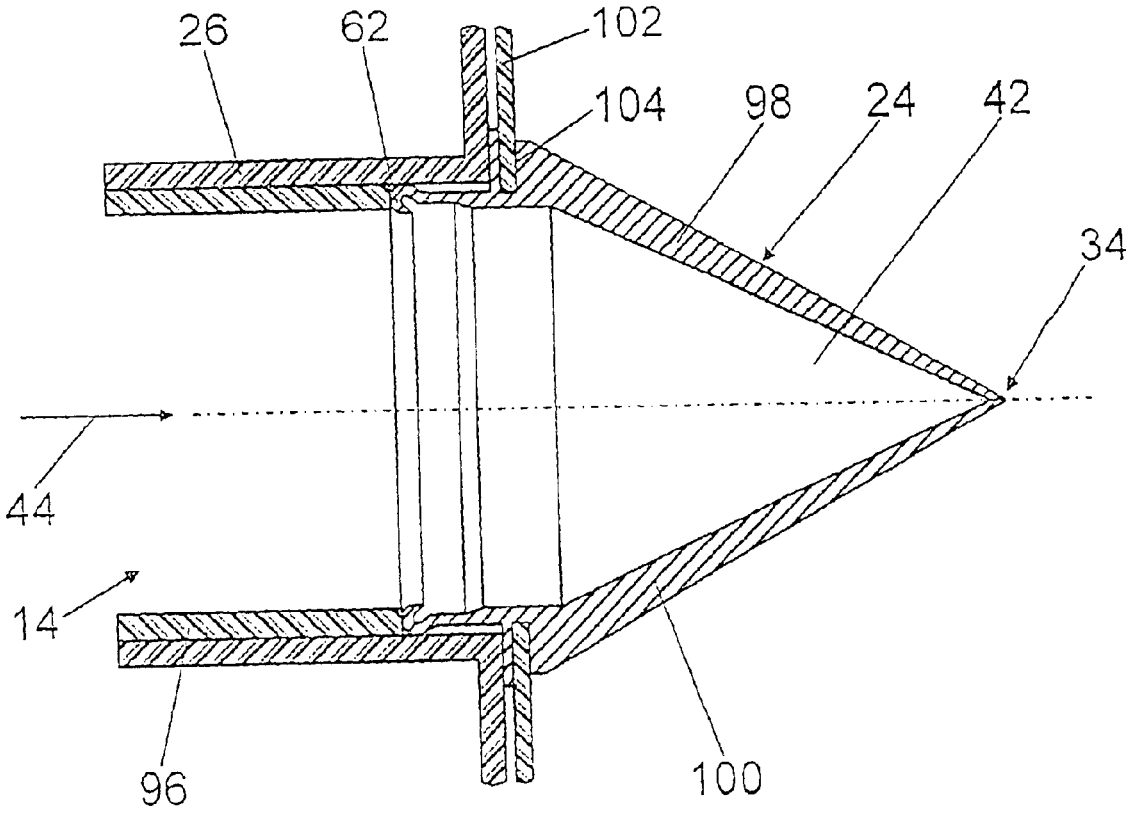
FIG. 8 is a variant of FIG. 2 with a separate support piece.

FIG. 8 shows a view of a retaining element 24 made of an elastomer or ethylene-propylene rubber (EPDM) having walls 98, 100 extending toward each other in the transport direction 44 that come to bear against each other at an end pointing in the transport direction 44, forming a passage 34. The retaining element 24—like the retaining element 22—has an oval base surface and forms a channel 42 tapering in the transport direction 44. The walls 98, 100 have a thickness that decreases in accordance with a linear function in the direction toward the passage 34. A hook-shaped seal 62 is integrally molded on the retaining element 24, which said hook-shaped seal seals radially outwardly at a connection piece 26 of a storage container (not shown in greater detail) and against the transport direction 44 at an end face of a connection piece 96 of an oscillating sander forming a transport channel 14. In order to stabilize a region of the retaining element 24 closest to the connection piece 96 and/or the oscillating sander, a separate support piece 102 is provided that reaches radially from the outside into an annular groove 104 of the retaining element 24.

| Reference Numerals | |
|---|---|
| 10 | Hand power tool |
| 12 | Transport channel |
| 14 | Transport channel |
| 16 | Storage container |
| 18 | Retaining element |
| 20 | Retaining element |
| 22 | Retaining element |
| 24 | Retaining element |
| 26 | Connection piece |
| 28 | Passage |
| 30 | Passage |
| 32 | Passage |
| 34 | Passage |
| 36 | Channel |
| 38 | Channel |
| 40 | Channel |
| 42 | Channel |
| 44 | Transport direction |
| 46 | Protrusion |
| 48 | Wall |
| 50 | Wall |
| 52 | Wall |
| 54 | Wall |
| 56 | Incision |
| 58 | Incision |
| 60 | Seal |
| 62 | Seal |
| 64 | Support part |
| 66 | Housing part |
| 68 | Handle |
| 70 | Handle |
| 72 | Operating switch |
| 74 | Handle |
| 76 | Tool carrier |
| 78 | Housing part |
| 80 | Side wall |
| 82 | Side wall |
| 84 | Side wall |
| 86 | Side wall |
| 88 | Wall |

-continued

| Reference Numerals | |
|---|---|
| 90 | Incision |
| 92 | Incision |
| 94 | Connection piece |
| 96 | Connection piece |
| 98 | Wall |
| 100 | Wall |
| 102 | Support piece |
| 104 | Annular groove |

What is claimed is:

1. A dust and chip removal device for sanding hand power tools, comprising a storage container securable to a hand power tool; a transport channel via which dust and chips are directed into said storage container; a retaining element preventing the dust and chips from flowing back out of said storage container, said retaining element having at least one passage; an elastic element which has a holding force closing said at least one passage, said passage being openable automatically against the holding force starting at a certain delivery pressure, while said elastic element automatically closes said passage below a certain delivery pressure; and a channel having a cross-sectional area which tapers toward said passage.

2. A dust and chip removal device as defined in claim 1, wherein said retaining element is composed of a soft-elastic material, said retaining element and said elastic element being formed as a single component.

3. A dust and chip removal device as defined in claim 1, wherein said retaining element forms said tapering channel.

4. A dust and chip removal device as defined in claim 1; and further comprising a protrusion which extends in a direction opposite to a transport direction and forms said tapering of said channel.

5. A dust and chip removal device as defined in claim 1, wherein said tapering channel has at least one wall extending along an exponential function in a transport direction.

6. A dust and chip removal device as defined in claim 1, wherein said retaining element has a wall thickness which decreases as it nears said passage.

7. A dust and chip removal device as defined in claim 1, wherein said passage is formed by at least two intersecting incisions.

8. A dust and chip removal device as defined in claim 1; and further comprising at least one seal which is integrally molded on said retaining element.

9. A dust and chip removal device as defined in claim 1; and further comprising a support place composed of plastic and integrally molded on said retaining element.

* * * * *